US010518958B2

(12) United States Patent
Senn et al.

(10) Patent No.: US 10,518,958 B2
(45) Date of Patent: Dec. 31, 2019

(54) CARTRIDGE WITH REDUCED FRICTION

(71) Applicant: Sulzer Mixpac AG, Haag (CH)

(72) Inventors: Florian Senn, Vogelsang (CH); Victor Clemens, Buchs (CH)

(73) Assignee: SULZER MIXPAC AG, Haag (CH)

( * ) Notice: Subject to any disclaimer, the term of this patent is extended or adjusted under 35 U.S.C. 154(b) by 0 days.

(21) Appl. No.: 16/065,394

(22) PCT Filed: Dec. 21, 2016

(86) PCT No.: PCT/EP2016/082069
§ 371 (c)(1),
(2) Date: Jun. 22, 2018

(87) PCT Pub. No.: WO2017/108886
PCT Pub. Date: Jun. 29, 2017

(65) Prior Publication Data

US 2019/0002186 A1 Jan. 3, 2019

(30) Foreign Application Priority Data

Dec. 23, 2015 (EP) ..... 15202479

(51) Int. Cl.
*B65D 83/00* (2006.01)
*B05C 17/005* (2006.01)

(52) U.S. Cl.
CPC .... *B65D 83/0005* (2013.01); *B05C 17/00576* (2013.01)

(58) Field of Classification Search
CPC ..... B65D 83/005; B05C 17/00576; A61M 5/31513
USPC ..... 222/327, 326, 328, 249, 250, 253, 256, 222/259, 260
See application file for complete search history.

(56) References Cited

U.S. PATENT DOCUMENTS 4,439,184 A * 3/1984 Wheeler ..... A61M 3/005 604/191
5,016,782 A 5/1991 Pfanstiel
5,501,673 A * 3/1996 Hjertman ..... A61M 5/2448 34/296
5,593,066 A 1/1997 Konuma
9,333,299 B2 * 5/2016 Kanazawa ..... A61M 5/284
(Continued)

FOREIGN PATENT DOCUMENTS

CN 1093024 A 10/1994
CN 1908455 A 2/2007
(Continued)

OTHER PUBLICATIONS

International Preliminary Report on Patentability and Written Opinion dated Jun. 26, 2018 in corresponding International Application No. PCT/EP2016/082069, filed Dec. 21, 2016.
(Continued)

*Primary Examiner* — Lien M Ngo
(74) *Attorney, Agent, or Firm* — Global IP Counselors, LLP

(57) ABSTRACT

A cartridge fillable or filled with a dispensable medium for dispensing the medium by movement of a piston receivable or received in the cartridge has a sliding surface for the piston to slide along during the movement of the piston. The sliding surface has a microstructure for reducing the friction between the piston and the sliding surface.

20 Claims, 2 Drawing Sheets

(56) References Cited

U.S. PATENT DOCUMENTS

| | | | | |
|---|---|---|---|---|
| 2002/0045865 | A1* | 4/2002 | Mitomi ..... | A61M 5/3134<br>604/207 |
| 2007/0032335 | A1 | 2/2007 | Goto et al. | |
| 2011/0129644 | A1 | 6/2011 | Rule et al. | |
| 2011/0309111 | A1 | 12/2011 | Helmenstein | |

FOREIGN PATENT DOCUMENTS

| | | | |
|---|---|---|---|
| CN | 101634324 | A | 1/2010 |
| CN | 102407977 | A | 4/2012 |
| CN | 203280850 | U | 11/2013 |
| DE | 8025336 | U1 | 7/1981 |
| DE | 3624638 | A1 | 2/1988 |
| EP | 0189521 | A2 | 8/1986 |
| EP | 1111225 | A1 | 6/2001 |
| EP | 2977023 | A1 | 1/2016 |
| JP | 05630635 | B2 | 11/2014 |
| WO | 2008033045 | A1 | 3/2008 |
| WO | 2016014764 | A1 | 1/2016 |

OTHER PUBLICATIONS

International Search Report dated Mar. 6, 2017 in corresponding International Application No. PCT/EP2016/082069, filed Dec. 21, 2016.

* cited by examiner

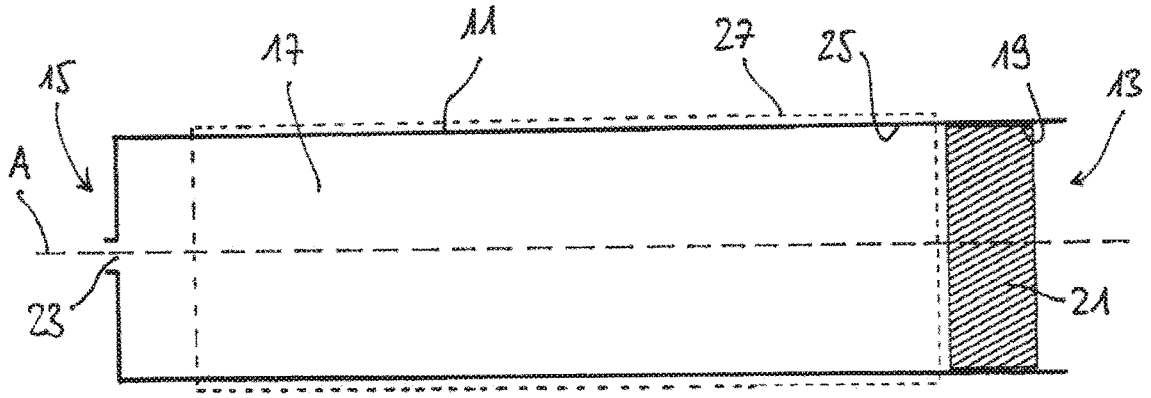
Fig. 1
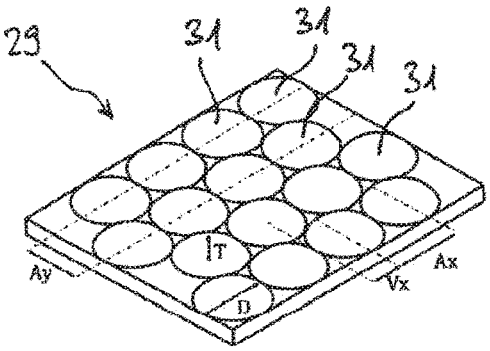
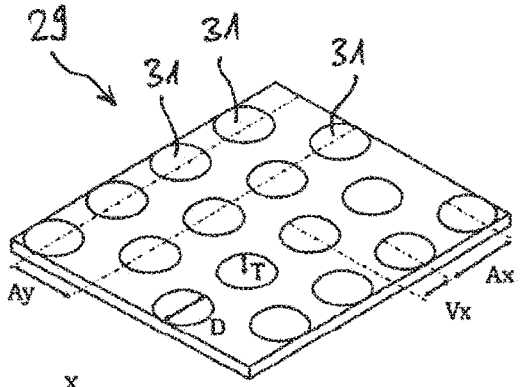
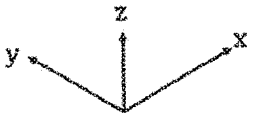
Fig. 2A
Fig. 2B
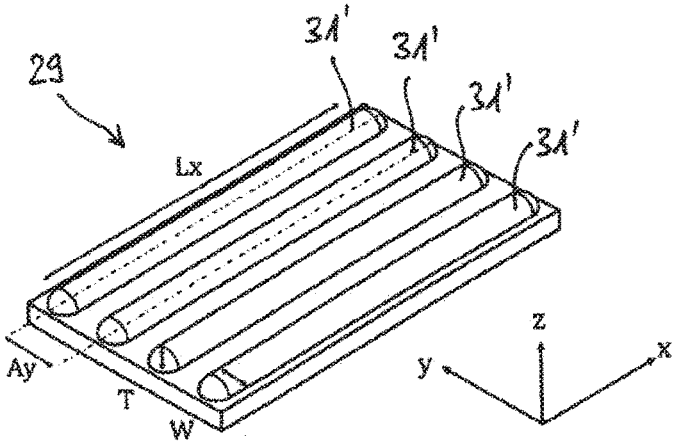
Fig. 3

CARTRIDGE WITH REDUCED FRICTION

CROSS-REFERENCE TO RELATED APPLICATION

This application is a U.S. National Stage application of International Application No. PCT/EP2016/082069, filed Dec. 21, 2016, which claims priority to European Patent Application No. 15202479.0, filed Dec. 23, 2015, the contents of each of which are hereby incorporated herein by reference.

BACKGROUND

Field of the Invention

The invention relates to a cartridge which is filled or Tillable with a dispensable medium. Especially, a hollow cartridge having a chamber formed within the cartridge to contain the medium. A piston can be received in the cartridge, which in particular closes the chamber at one end. To dispense the medium out of the cartridge at an opposite end, the piston can then be moved such that the volume of the chamber is reduced and the medium is pressed out of the cartridge, for example through a discharge opening of the cartridge.

Background

Prior to dispensing, a medium can be prefilled into the cartridge and possibly be stored therein for some time. Also, at least parts of the medium may remain in the cartridge between individual applications. Therefore cartridges can suited not only for dispensing, but also for storing the respective medium.

Most importantly, leakage of the medium must be prevented. Furthermore, a variety of mediums which are usually dispensed by a cartridge are susceptible to drying out. Therefore it may be necessary that moisture cannot leave the chamber of the cartridge. But it can also be necessary to prevent intrusion from the outside. Some mediums might have to be sealed against air, especially oxygen, and/or moisture so as to prevent premature chemical reaction of the medium, for example.

SUMMARY

It hence might be important that the chamber containing the medium be tightly sealed. In particular, the piston should be in contact to the cartridge as sealingly as necessary. Tight sealing can for example be achieved by high force acting perpendicularly between the piston and the cartridge wall and/or by as perfectly as possible matching contact surfaces of the piston and the cartridge.

However, high forces and a large contact area also lead to increased friction between the piston and the cartridge. High friction—in addition to possible back pressure from squeezing the medium (which usually has a substantial viscosity) through a discharge opening, a nozzle and/or a mixing tip, for example—increases the required force to be applied to the piston for dispensing the medium by movement of the piston.

In order to facilitate dispensing, it is therefore desirable that the friction between the piston and a sliding surface of the cartridge along which the piston slides during a discharge movement of the piston be reduced, though without compromising the tight sealing.

Document DE 36 24 638 A1 discloses a cartridge that can be filled with a medium by movement of a piston receivable or received in the cartridge.

It is an objective of the invention to provide a cartridge for a dispensable medium which can be dispensed by movement of a piston, with the cartridge being adapted such that a force required for moving the piston is reduced, while tight sealing between the piston and the cartridge is maintained.

The objective is solved by a cartridge as discussed herein.

The cartridge is fillable or filled with a dispensable medium which can be dispensed by movement of a piston receivable or received in the cartridge. The cartridge has a sliding surface for the piston to slide along during the movement of the piston. In particular, the sliding surface is an inner surface of the cartridge interacting with an outer surface of the piston. For example, the cartridge may have an at least essentially hollow cylindrical form with the sliding surface being an inner circumferential surface of this form. However, the cartridge may alternatively have a form with another than circular cross-section. In any case, the outer cross-sectional shape of the piston preferentially is complementary to a respective inner cross-sectional shape of the cartridge.

An essential aspect of the invention is that the sliding surface has a microstructure for reducing the friction between the piston and the sliding surface, especially compared to the friction for a conventional cartridge having a sliding surface without microstructure. In particular, the microstructure is such that a contact area between the piston and the sliding surface is reduced in comparison to a sliding surface of generally similar kind, but without the microstructure.

The microstructure in particular refers to structural features of the sliding surface on a microscale, with these structural features being formed according to a certain, especially specific, regular and/or periodic, pattern. The microscale generally comprises structures in the order of nanometers to millimeters and preferentially structures in the order of micrometers. For example, dimensions (height/depth, width, length) of a single structural element, distances between neighboring structural elements and/or a periodicity of the arrangement of structural elements of the microstructure can be in the order of sub-micrometers to tens of micrometers.

In particular, due to the microstructure the sliding surface is not flat and especially not perfectly complementary to a corresponding surface of the piston with which the piston slides along the sliding surface, this corresponding surface of the piston being usually rather flat or being part of a sealing lip. Therefore the microstructure reduces the fraction of the sliding surface being in direct contact to the piston. This in addition to possible other effects of the microstructure may lead to a reduced friction between the piston and the cartridge.

Reducing the contact area between the piston and the cartridge for reduced friction could generally also be achieved by structuring the sliding surface of the cartridge on a macroscopic scale in the order of centimeters or larger. However, a macroscopic structure of the sliding surface could lead to retarding of the piston at the sliding surface, which could result in increasing the force required for moving the piston rather than decreasing this force as envisaged. Furthermore, when reducing the contact area on such a scale, the risk of leakage through the contact increases, in particular because in a macrostructure passageways between the piston and the sliding surface can form through which for example air, moisture or even the medium contained in the cartridge might be able to penetrate.

However, it is a discovery of the invention that by structuring the sliding surface on a microscale it is possible to significantly reduce the contact area and thereby the friction between the piston and the cartridge without at the same time disengaging the piston and the cartridge from each other to such an extent that they no longer are in sealingly tight contact to each other.

A microstructure can be formed in different materials by different means. For example, the microstructure can be a result of self-organization; it can be applied to the sliding surface after production of the remaining cartridge as a separate layer or by subsequent processing such as ablation; or it can be formed together with the cartridge. In particular, a mold core used for forming the cartridge by injection molding can have a complementary microstructure so that the microstructure is necessarily embedded in the sliding surface immediately through the molding. The microstructure of such a mold core can for example be created by laser ablation which allows for precise formation of shapes and arrangements in the microscale.

According to an embodiment, the cartridge comprises one of polypropylene, polyamide and polybutylene terephthalate. These materials are well-suited, especially with respect to their mechanical strength, elastic modulus, chemical inertness, diffusion tightness and/or workability, for cartridges in combination with a variety of different dispensable mediums normally used in cartridges. Furthermore, with these materials a cartridge can be formed by injection molding, which is a simple and effective method of cartridge production. In particular, these materials allow for formation of a microstructure in a surface of the material.

Furthermore, the piston preferably comprises one of polypropylene, polyamide and low-density polyethylene. The piston may have a sealing lip with which the piston is in contact to the sliding surface of the cartridge when it is received in the cartridge and slides along the sliding surface during movement of the piston for dispensing a dispensable medium contained in the cartridge. This sealing lip can in particular be more flexible than the core of the piston such that the sealing lip ensures a tight fit of the piston within the cartridge. If the piston has a sealing lip, preferably at least the sealing lip of the piston comprises one of polypropylene, polyamide and low-density polyethylene. Similar to the materials mentioned for the cartridge, these materials are especially advantageous for the production and functioning of the piston. However, the most suitable material for the piston might depend in particular on the respective material of the cartridge the piston is used with.

The microstructure of a cartridge according to the invention is formed by a plurality of protrusions, with a height of a respective protrusion being defined in a direction perpendicular to the sliding surface and a width of a respective protrusion being defined in a direction perpendicular to the height and to a sliding direction of the piston. In particular, said protrusions extend from an otherwise flat plane of the sliding surface. The height of an individual protrusion then at least essentially corresponds to a maximum extension of the protrusion from that plane. The width of an individual protrusion of the microstructure is especially defined as a maximum extension of the protrusion along a direction which is perpendicular to the height of the protrusion and to a sliding direction. This sliding direction relates to the direction in respect of which the sliding surface is adapted for the piston to slide along. Hence a piston received in the cartridge will slide in the sliding direction along the sliding surface when moved to dispense the dispensable medium.

The heights and widths of the protrusions have a significant impact on the friction and tightness at the contact between the piston and the sliding surface of the cartridge. In particular, the height can have an influence on the force being effective between the piston and the sliding surface, whereas the width may especially affect the actual contact area of the piston to the sliding surface. The tightness of the contact can be affected by both the height and the width as well as further parameters, as for example a spacing of the protrusions (pitch). Preferably, the height of the protrusions is less than the width, in particular less than half of the width, of the protrusions, which may lead to a proper balance between reduced friction and sufficient tightness.

According to an embodiment, the protrusions have a height of between around 0.2 μm and around 5 μm and/or a width of between around 1 μm and around 50 μm. Preferably the protrusions have a height of between around 0.25 μm and around 2.5 μm and/or a width of between around 4 μm and around 15 μm. In particular the protrusions have a height of between around 0.5 μm and around 1.5 μm and/or a width of between around 6 μm and around 12 μm. These ranges, and in particular the given combinations of height and width ranges, have turned out to be especially advantageous to the objective of the invention.

Here and in the following, specified height and width ranges correspond to the heights and widths of the individual protrusions of the microstructure. A given range means that all protrusions have respective heights or width within this range, but this does not necessarily also mean that all protrusions share the same height or width. In fact, the heights or widths of the protrusions might vary within the given range. However, generally it is preferred that all protrusions at least essentially have the same height and/or width.

According to an embodiment, the protrusions are regularly arranged over at least part of the sliding surface, in particular arranged on a two-dimensional Bravais lattice. While generally the protrusions can also be arranged disorderedly or at least aperiodically, preferably they are arranged according to a periodic pattern. In this way, the characteristics of the sliding surface with respect to friction and tightness are at least essentially homogeneous over the entire sliding surface.

Generally, all protrusions of the microstructure need not have the same shape. For example, the microstructure may comprise different groups of protrusions, with the protrusions of the same group having the same shape and the protrusions of different groups having different shapes. These groups are not necessarily spatially separated from each other, but may be arranged intermittently. In this way, advantages of different shapes may be combined. Preferably, however, all protrusions of the microstructure have the same shape, as this may, for example, facilitate producing the microstructure.

According to an embodiment, the protrusions have an at least essentially circular base. In particular, the protrusions are at least essentially formed as spherical domes. Such a shape is comparatively simple to produce. Also, due to its symmetry the shape cannot be incorrectly oriented with respect to the sliding direction of the piston. As mentioned above, preferably the height of the protrusion is less than its width. Especially the height of the protrusion is not more than half its width. Therefore, if the protrusion is formed as a spherical dome, the width of the protrusion might be less than the diameter of the spherical dome and especially corresponds to the diameter of the circular base of the spherical dome.

Protrusions with a circular base can generally be arranged irregularly or, preferably, regularly in a variety of different ways. Preferentially, however, such protrusions are arranged in a centered rectangular lattice, in particular in a hexagonal lattice, which allows for dense packing of the protrusions. Especially, it is preferred that the protrusions be arranged pursuant to a uniform circle packing, in particular to a hexagonal circle packing with respect to the circular bases of the protrusions.

In testing various configurations with respect to a material of the sliding surface and to dimensions of the protrusions formed in the sliding surface, different combinations have proven to be particularly suitable to achieve a significant reduction of friction between a respective piston and the sliding surface while nevertheless maintaining sufficient tightness. The following embodiments give examples of such advantageous combinations.

According to an embodiment, the sliding surface comprises polypropylene and the protrusions have a height of between around 0.5 μm and around 2.5 μm and a width of between around 4 μm and around 12 μm.

According to another embodiment, the sliding surface comprises polyamide and the protrusions have a height of between around 0.5 μm and around 1.5 μm and a width of between around 1 μm and around 8 μm.

According to a further embodiment, the sliding surface comprises polybutylene terephthalate and the protrusions have a height of between around 0.5 μm and around 2.5 μm and a width of between around 1 μm and around 10 μm.

According to yet another embodiment, the sliding surface comprises polybutylene terephthalate and the protrusions have a height of around 3 μm and a width of around 10 μm. In such an embodiment, the piston preferably comprises polyamide.

Besides a microstructure with protrusions having a circular base, microstructures with protrusions having other shapes might also lead to the desired effects. In particular, according to an alternative embodiment, the protrusions have an at least essentially elongated form extending along the sliding direction. This especially means that the extension of a protrusion in the sliding direction (i.e. the length of the protrusion) is larger than the width of the protrusion, in particular substantially larger, for example at least twice the width, preferably at least ten times the width of the protrusion. Furthermore, the length of the protrusions can extend over the entire longitudinal extension of the microstructure. In such a case, the length of the protrusions can even be about three orders of magnitude greater than the width of the protrusions.

According to an embodiment, the protrusions are at least essentially formed as cylinder segments with the cylinder axes of the cylinder segments being parallel to the sliding direction. The cross-sectional shape of such a cylinder segment is a circular segment, which is defined by a circular arc extending over less than 360° and the chord connecting the ends of the arc. The chord then in particular lies in the plane of the sliding surface, while the arc (and hence the cylinder segment) protrudes therefrom. The width of such a protrusion is at most equal to the diameter of the cylinder segment. If the height of the protrusion is less than half the diameter of the cylinder segment, its width corresponds to the length of the chord.

When the protrusions have an at least essentially elongated form extending along the sliding direction, the sliding surface preferably comprises polyamide and the protrusions preferably have a height of around 1 μm and a width of around 12 μm. Furthermore, in this case, the piston preferentially comprises low-density polyethylene. Such a configuration has turned out to lead to a significantly reduced friction between the piston and the sliding surface, yet without excessive leakiness. The length of the protrusions can especially be in the order from tens of micrometers to hundreds of millimeters, for example 10 mm or 20 mm.

It is not necessary that the microstructure has protrusions of the same kind only. In particular, different kinds of protrusions, for example both kinds of protrusions described above (having an at least essentially circular base or having an at least essentially elongated form extending along the sliding direction, respectively), can by mixed in a single microstructure. According to an embodiment, the microstructure is formed by a first group of protrusions and a second group of protrusions, wherein the protrusions of the first group have an at least essentially circular base and wherein the protrusions of the second group have an at least essentially elongated form extending along the sliding direction.

Independent of the shape of respective protrusions, it might be preferred to restrict the microstructure to a specific section of the cartridge. According to an embodiment, the cartridge has an elongated form extending along a cartridge axis from a first end to a second end, with the piston being received through the first end for dispensing the dispensable medium through the second end by applying a driving force to the piston towards the second end, wherein the microstructure is formed only within a longitudinal region of the sliding surface with respect to the cartridge axis, the longitudinal region being spaced from the first end of the cartridge by at least the longitudinal extension of the piston along the cartridge axis.

It is common with cartridges that the piston is received in the cartridge long before the dispensable medium contained in a chamber of the cartridge is actually dispensed. In such a case, prior to actually dispensing the medium, the piston at least primarily serves to seal the chamber at the first end of the cartridge. For this, the piston is usually located close to the first end of the cartridge through which it is inserted. In such an initial state, the piston preferably already is in tight contact to the sliding surface of the cartridge such that dispensing the medium out of the cartridge can be readily initiated by pushing the piston towards the second end of the cartridge. Due to the microstructure of the sliding surface along which the piston then slides the friction between the piston and the sliding surface and thus the necessary driving force for moving the piston are reduced.

However if the sliding surface is microstructured also in that longitudinal region which is in contact to the piston in said initial state, the static long-term pressure between the piston and said region of the sliding surface could damage the sealing lip of the piston or the microstructure of the sliding surface. In particular, the material of the sliding surface, especially if it contains plastic, might start to flow under pressure. This or other pressure-related effects could level the sliding surface in this region. Therefore, preferably, no microstructure is formed in the longitudinal region of the sliding surface.

The longitudinal extension, i.e. the extension in direction of the cartridge axis, of the region hence at least essentially corresponds to the longitudinal extension of the piston or may be greater. In this context, longitudinal extension of the piston refers to the longitudinal extension of that part of the piston which is actually plugged into the cartridge and clogs the cartridge at its first end, and especially to the longitudinal extension of a piston jacket or a sealing lip which is in contact with the sliding surface of the cartridge. A piston rod or the like, if present, does not contribute to the longitudinal extension of the piston.

The invention also relates to a filled cartridge, i.e. a cartridge which has the features of at least one of the embodiments described above and which is filled with a dispensable medium.

The objective of the invention is also solved by a method for producing a cartridge, in particular a cartridge in accordance with at least one of the embodiments described above, wherein the method comprises forming the cartridge by injection molding using a mold core having a microstructure complementary to the microstructure (to be formed) of the sliding surface of the cartridge. Especially such a complementary microstructure may comprise depressions corresponding to protrusions as describe above.

The (complementary) microstructure of the mold core can in particular be formed by laser ablation. Using a laser allows for reliable control over the shape and position of individual depressions ablated from the mold core with microscale precision. Once a suitable mold core having the microstructure is formed, cartridges with microstructured sliding surfaces can be produced repeatedly from the same mold core with high throughput and adequate accuracy.

DESCRIPTION OF THE DRAWINGS

The invention will be explained in more detail hereinafter with reference to the drawings.

FIG. 1 shows a schematic illustration of an embodiment of the cartridge.

FIG. 2A and FIG. 2B show schematic illustrations of details of respective micro structures of the sliding surfaces of different embodiments of the cartridge.

FIG. 3 shows a schematic illustration of details of the microstructure of the sliding surface of a further embodiment of the cartridge.

DETAILED DESCRIPTION OF THE EMBODIMENTS

Figure 4:
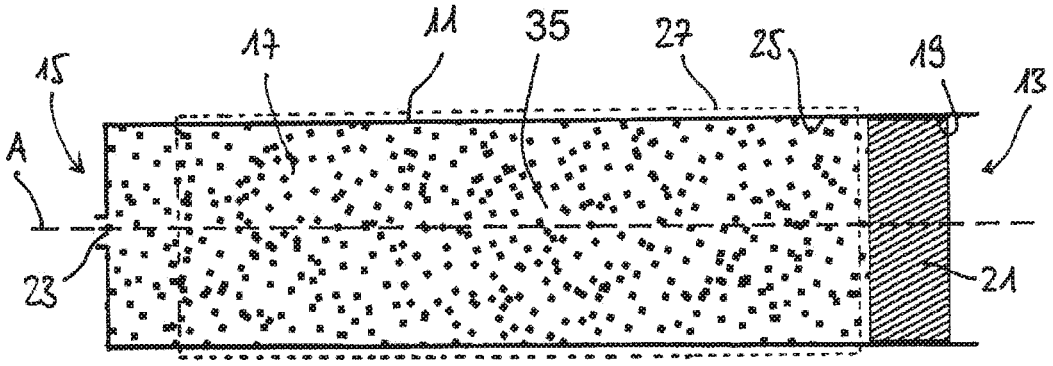
FIG. 4 shows a schematic illustration of the cartridge according to FIG. 1 filled with a dispensable medium.

In FIG. 1, an embodiment of a cartridge 11 is shown in a schematic illustration. The cartridge 11 is formed by injection molding and has an essentially cylindrical form, in particular with a slight conicity of for example about 0.02°, to facilitate separation of the cartridge 11 from a mold core (not shown) during production. The cartridge 11 extends along a cartridge axis A from a first end 13 (at the right of FIG. 1) to a second end 15 (at the left of FIG. 1).

The cartridge 11 is hollow so that a chamber 17 is formed inside the cartridge 11 which is pre-filled or fillable with a dispensable medium (not shown). At the first end 13 the cartridge 11 has a reception opening 19 through which the dispensable medium can be filled into the cartridge 11 and through which a piston 21 can be received. The piston 21, which also has an essentially cylindrical form, has an outer diameter corresponding to an inner diameter of the cartridge 11. At its outer circumference the piston 21 has a sealing lip (not shown) which is flexible to such an extent that the outer diameter of the piston 21 adapts to the slightly varying inner diameter of the cartridge 11 for a continuously tight fit sealing the chamber 17 towards the first end 13 of the cartridge 11.

The piston 21 is shown in an initial state, in which it is received in the cartridge 11 to seal the chamber 17 at a maximum volume. Starting from this initial state, the piston 21 can be moved in a sliding direction, which corresponds to movement along the cartridge axis A towards the second end 15, to reduce the volume of the chamber 17 and thus to press the medium contained in the chamber 17 through a discharge opening 23 at the second end of the cartridge 11 out of the cartridge 11.

During such a movement of the piston 21, the piston 21, especially the sealing lip of the piston 21, slides along a sliding surface 25 of the cartridge 11 which is an inner circumferential surface of the cartridge 11. In a longitudinal region 27 (with respect to the cartridge axis A) of the sliding surface 25, a microstructure 29 is formed in the sliding surface 25 so as to reduce the contact area between the piston 21 and the sliding surface 25 in the longitudinal region 27. As a result of this microstructuring, the friction—at least one of the sliding friction and the static friction, preferentially both—between the piston 21 and the sliding surface 25 is reduced. Adjacent to one or both ends of the longitudinal region 27 the sliding surface may or may not include a microstructure. For front-filling it may be advantageous to have at least the region of the sliding surface 25 which is adjacent to the discharge opening 23 without microstructure. This region defines the position of the piston 21 in the empty cartridge 11 (before filling) and since the piston may remain at this position for a long time before the cartridge 11 is filled it may be advantageous to have this region unstructured. The region of the sliding surface adjacent to the first end 13 of the cartridge 11 may be advantageously unstructured for both, front-filling and back-filling. The piston 21 remains in this region during storage of the cartridge 11 it may be advantageous to have this region unstructured.

FIGS. 2A and 2B as well as FIG. 3 show details of microstructures 29 of different embodiments of the cartridge 11.

The microstructures 29 of FIGS. 2A and 2B are illustrative for a first type of microstructure 29 comprising regularly arranged protrusions 31 with an at least essentially circular base. The protrusions 31 of the shown microstructures 29 are formed as spherical domes protruding from a plane 33 of the sliding surface 25. The height T of the protrusions 31 is smaller than their width, which corresponds to the diameter D of the circular base of the protrusions 31 and is about 10 μm.

The microstructures 29 of FIGS. 2A and 2B differ in particular in their respective arrangement pattern. In the microstructure 29 shown in FIG. 2A, the protrusions 31 are densely arranged according to a hexagonal circle packing, whereas in the microstructure 29 shown in FIG. 2B, the arrangement is less dense as the protrusions 31 are spaced from each other, though also being arranged in a hexagonal or in an at least centered rectangular lattice, where the pitch Vx between the protrusions 31 of adjacent lines of the pattern is just half the pitch Ax of the protrusions 31 of the same line. If the lattice is hexagonal, the line pitch Ay is furthermore equal to the pitch Ax of the protrusions 31 within a respective line.

The hexagonal pattern has a high degree of symmetry and hence a rather high degree of isotropy at least on the macroscopic scale. Notwithstanding this, a microstructure 29 of the type shown in FIGS. 2A and 2B is preferably oriented such that lines of the respective pattern are parallel to the sliding direction or to the cartridge axis A, respectively. This is the case in FIGS. 2A and 2B as the sliding direction and the direction of the cartridge axis A are both parallel to the x-axis indicated in Figures.

The microstructure 29 shown in FIG. 3 is less isotropic than the microstructures 29 of FIGS. 2A and 2B, since the protrusions 31' of this type of microstructure 29 have an at least essentially elongated form and hence are rotationally asymmetric. Due to this asymmetry the orientation of the microstructure 29 may have an influence on the friction between the piston 21 and the sliding surface 25 of the cartridge 11. Preferably, the protrusions 31' of the microstructure 29 shown in FIG. 3 extend along the sliding direction parallel to the cartridge axis A (this corresponds to the x-axis indicated in FIG. 3) with a regular spacing Ay in a direction perpendicular to the sliding direction.

The protrusions 31' are formed as cylinder segments lying with their flat side in the plane 33 of the sliding surface 25 and having cylinder axes parallel to the sliding direction (and hence to the cartridge axis A). The height T of the protrusions 31' is slightly smaller than half of their width W, which is about 12 μm. The length Lx of the protrusions 31' in a direction parallel to the sliding direction is about ten times the width W, but may be much larger, especially in the same order of magnitude as the longitudinal extension of the entire microstructure 29 with respect to the cartridge axis A, which may amount to several centimeters.

Providing a microstructure 29 at the sliding surface 25, in particular providing one of the two types of microstructure 29 exemplarily shown and described above, is a simple and effective manner of reducing the friction between the piston 21 and the sliding surface 25 of the cartridge 11 to facilitate discharge of a medium out of the cartridge 11 without unduly impairing the tight sealing of the chamber 17 by the piston 21.

FIG. 4 shows the cartridge 11 of FIG. 1 filled with a dispensable medium 35. In such a pre-filled cartridge 11 the microstructure 29 reduces the friction between the piston 21 and the sliding surface 25 for facilitating dispensing the medium 35 through the discharge opening 23, without at the same time disengaging the piston 21 and the cartridge 11 from each other to such an extent that they no longer are in sealingly tight contact to each other. The cartridge 11 therefore is particularly suited not only for dispensing, but also for storing the medium 35 until dispensing the medium 35 (partly or fully) is actually desired. An undesired leakage of the medium 35, drying out or chemical reaction of the medium 35 with environmental oxygen or moisture is nevertheless prevented.

The invention claimed is:

1. A cartridge fillable or filled with a dispensable medium for dispensing the medium by movement of a piston receivable or received in the cartridge, the cartridge comprising:

a sliding surface for the piston to slide along during the movement of the piston, the sliding surface having a microstructure configured to reduce friction between the piston and the sliding surface, the microstructure formed by a plurality of protrusions, a height of a respective protrusion being defined in a direction perpendicular to the sliding surface and a width of a respective protrusion being defined in a direction perpendicular to the height of the protrusion and to a sliding direction of the piston.

2. The cartridge in accordance with claim 1, wherein the cartridge comprises one of polypropylene, polyamide and poly-butylene terephthalate, and the piston comprises one of polypropylene, polyamide and low-density polyethylene.

3. The cartridge in accordance with claim 1, wherein the height of the protrusions is less than the width of the protrusions.

4. The cartridge in accordance claim 1, wherein the protrusions have a height of between around 0.2 μm and around 5 μm or a width of between around 1 μm and around 50 μm.

5. The in accordance with claim 1, wherein the protrusions are regularly arranged over at least part of the sliding surface.

6. The cartridge in accordance with claim 1, wherein the protrusions have an at least essentially circular base.

7. The cartridge in accordance with claim 6, wherein the protrusions are arranged pursuant to a uniform circle packing.

8. The cartridge in accordance with claim 6, wherein the sliding surface comprises polypropylene and the protrusions have a height of between around 0.5 μm and around 2.5 μm and a width of between around 4 μm and around 12 μm.

9. The cartridge in accordance with claim 6, wherein the sliding surface comprises polyamide and the protrusions have a height of between around 0.5 μm and around 1.5 μm and a width of between around 1 μm and around 8 μm.

10. The cartridge in accordance with claim 6, wherein the sliding surface comprises polybutylene terephthalate and the protrusions have a height of between around 0.5 μm and around 2.5 μm and a width of between around 1 μm and around 10 μm.

11. The cartridge in accordance with claim 6, wherein the sliding surface comprises polybutylene terephthalate and the protrusions have a height of around 3 μm and a width of around 10 μm, and the piston comprises polyamide.

12. The cartridge in accordance with claim 1, wherein the protrusions have an at least essentially elongated form extending along the sliding direction.

13. The cartridge in accordance with claim 12, wherein the sliding surface comprises polyamide and the protrusions have a height of around 1 μm and a width of around 12 μm, and the piston comprises low-density polyethylene.

14. The cartridge in accordance with claim 1, wherein the cartridge has an elongated form extending along a cartridge axis from a first end to a second end, with the piston being receivable or received through the first end for dispensing the dispensable medium through the second end by applying a driving force to the piston towards the second end, and the microstructure is formed only within a longitudinal region of the sliding surface with respect to the cartridge axis, the longitudinal region being spaced from the first end of the cartridge by at least the longitudinal extension of the piston along the cartridge axis.

15. A method for producing a cartridge in accordance with claim 1 comprising forming the cartridge by injection molding using a mold core having a micro-structure complementary to the microstructure of the sliding surface of the cartridge, the microstructure of the mold core being formed by laser ablation.

16. The cartridge in accordance claim 1, wherein the protrusions have a height of between around 0.5 μm and around 1.5 μm or a width of between around 6 μm and around 12 μm.

17. The in accordance with claim 1,
wherein the protrusions are arranged on a two-dimensional Bravais lattice.

18. The cartridge in accordance with claim 1,
wherein the protrusions are at least essentially formed as spherical domes.

19. The cartridge in accordance with claim 6,
wherein the protrusions are arranged pursuant to a hexagonal circle packing.

20. The cartridge in accordance with claim 1,
wherein the protrusions are at least essentially formed as cylinder segments with the cylinder axes of the cylinder segments being parallel to the sliding direction.

* * * * *